US009616353B2

(12) United States Patent
Chan et al.

(10) Patent No.: US 9,616,353 B2
(45) Date of Patent: Apr. 11, 2017

(54) RECONFIGURABLE DOLL

(71) Applicant: Mattel, Inc., El Segundo, CA (US)

(72) Inventors: Patricia Chan, Redondo Beach, CA (US); Steven D. Ryniker, Torrance, CA (US); Andrew Lourits, Fullerton, CA (US)

(73) Assignee: Mattel, Inc., El Segundo, CA (US)

( * ) Notice: Subject to any disclaimer, the term of this patent is extended or adjusted under 35 U.S.C. 154(b) by 285 days.

(21) Appl. No.: 13/852,178

(22) Filed: Mar. 28, 2013

(65) Prior Publication Data

US 2013/0288564 A1 Oct. 31, 2013

Related U.S. Application Data

(60) Provisional application No. 61/618,000, filed on Mar. 30, 2012.

(51) Int. Cl.

| | |
|---|---|
| ***A63H 3/44*** | (2006.01) |
| ***A63H 3/52*** | (2006.01) |
| ***A63H 3/28*** | (2006.01) |

(52) U.S. Cl.

CPC ..... *A63H 3/52* (2013.01); *A63H 3/28* (2013.01); *A63H 3/44* (2013.01)

(58) Field of Classification Search

CPC ... A63H 3/44; A63H 3/28; A63H 3/36; A63H 13/005; A41D 15/00; A41D 15/02; A41D 15/04

See application file for complete search history.

(56) References Cited

U.S. PATENT DOCUMENTS

| | | | | |
|---|---|---|---|---|
| 698,205 | A * | 4/1902 | Lewis | A41D 1/14 2/211 |
| 888,232 | A * | 5/1908 | Galland | A41B 9/04 2/408 |
| 1,148,540 | A | 8/1915 | Sancier | |
| 1,396,766 | A | 11/1921 | McClelland | |
| 1,425,974 | A | 8/1922 | Kearney | |
| 1,784,369 | A * | 12/1930 | Lowenbaum | A41D 1/22 2/212 |
| 1,966,986 | A | 7/1934 | Martin | |
| 2,143,294 | A | 1/1939 | Whiting | |
| 2,899,962 | A * | 8/1959 | Entringer | A41B 9/08 2/211 |
| 3,538,638 | A | 11/1970 | Glass et al. | |
| 3,851,419 | A | 12/1974 | Kaelin | |
| 3,903,640 | A | 9/1975 | Dunn | |

(Continued)

FOREIGN PATENT DOCUMENTS

EP 0606790 B1 3/2000

*Primary Examiner* — Melba Bumgarner
*Assistant Examiner* — Amir Klayman
(74) *Attorney, Agent, or Firm* — Edell, Shapiro & Finnan, LLC

(57) ABSTRACT

A doll with reconfigurable hair and dress is disclosed. The hair is rotatably coupled to the top of the head of the doll and a switch within the head of the doll. Furthermore, the switch is connected to the output mechanism, dictating which output the output mechanism produces. When the hair rotates about the head of the doll, the switch is actuated, changing the output of the output mechanism. Additionally, the dress of the doll is capable from converting from a full gown that folds away to reveal a skirt.

9 Claims, 11 Drawing Sheets

(56) References Cited

U.S. PATENT DOCUMENTS

| | | | | |
|---|---|---|---|---|
| 4,067,066 | A * | 1/1978 | Bruno | A45C 9/00 2/105 |
| 4,639,233 | A | 1/1987 | Brassfield | |
| 4,856,666 | A * | 8/1989 | Easley | B65D 51/10 215/272 |
| 5,046,986 | A | 9/1991 | Wood et al. | |
| 5,149,289 | A | 9/1992 | Edwards et al. | |
| 5,607,336 | A | 3/1997 | Lebensfeld et al. | |
| 6,257,948 | B1 | 7/2001 | Silva | |
| 6,425,796 | B1 * | 7/2002 | Gaynor et al. | 446/298 |
| 6,554,679 | B1 | 4/2003 | Shackelford et al. | |
| 6,648,719 | B2 | 11/2003 | Chan | |
| 6,719,604 | B2 | 4/2004 | Chan | |
| 7,338,340 | B2 | 3/2008 | Poesch | |
| 2001/0041495 | A1 | 11/2001 | Chan | |
| 2002/0061700 | A1 | 5/2002 | Chan | |
| 2004/0194187 | A1 * | 10/2004 | Mayr | 2/46 |
| 2005/0215170 | A1 | 9/2005 | Poesch | |
| 2006/0262531 | A1 * | 11/2006 | Schrimmer et al. | 362/240 |
| 2007/0056076 | A1 * | 3/2007 | Gaugler et al. | 2/69 |
| 2007/0128979 | A1 | 6/2007 | Shackelford et al. | |
| 2010/0093254 | A1 | 4/2010 | Jung | |
| 2011/0111669 | A1 | 5/2011 | Chan et al. | |

* cited by examiner

RECONFIGURABLE DOLL

CROSS-REFERENCE TO RELATED APPLICATION

This application claims priority to and the benefit of U.S. Provisional Patent Application No. 61/618,000, filed Mar. 30, 2012, entitled "Reconfigurable Doll," the entire disclosure of which is incorporated herein by reference in its entirety.

FIELD OF THE INVENTION

The present invention relates to a doll that has multiple hair styles and outfits, and is easily converted from one set of styles to the other without removing or adding clothes or hair from the doll. Furthermore, the changing of the hair styles triggers a switch that determines the output of the doll.

BACKGROUND OF THE INVENTION

Children use their imagination when playing with dolls to imagine their dolls in a variety of scenarios, from singing on stage to driving in a car, to working in an office. When the dolls are interacting in each one of these scenarios, children require that the dolls be wearing the proper clothes and hair styles. Furthermore, dolls should output a signal that is appropriate for the doll's setting. For example, a doll in the office setting would not normally be dressed in a ballerina outfit discussing her dance moves.

Furthermore, with current dolls, users must manually remove a doll's clothes and put on the desired outfit for the doll. Moreover, if the user desired the doll to output a specific signal, the user would have to indicate which signal via a series of buttons, if multiple signals existed.

Therefore, there is a need for a doll whose outfit and hair can be easily reconfigured. In addition, depending on which hair and/or outfit is configured, the doll will output a signal that corresponds to the hair and/or outfit that is currently configured on the doll.

SUMMARY OF THE INVENTION

The present invention is directed to a doll with a body portion that includes a convertible dress or reconfigurable garment. The convertible dress contains a first garment portion and a second garment portion that can be positioned in the front of the second body portion or the back of the second body portion. Furthermore, the convertible dress includes a first string attached to the first garment portion and a second string attached to the second garment portion.

In another embodiment, the second body portion contains a guide member on the back of the second body portion with the first string and the second string being threaded through the guide member. Moreover, a locking tab that is attached to the first string and second string to lock the strings in place in the back of the second body portion.

In an alternative embodiment, a doll includes a first body portion having a front, a back, and a top. The first body portion contains a switch within the first body portion and hair rotatably mounted to the top of the first body portion. The hair is rotatably coupled to the switch. The hair has a first side and a second side, and the switch is triggered when the second side of the hair is rotated to the front of the first body portion. Furthermore, the doll contains a second body portion having a front, a back, and an output mechanism operably connected to the switch and having at least two outputs. The switch dictates which one of the at least two outputs the output mechanism performs or generates.

In another embodiment, the second body portion includes a convertible dress. The convertible dress contains a first garment portion and a second garment portion that can be positioned in front of the second body portion or behind the second body portion. Furthermore, the convertible dress includes a first string attached to the first garment portion and a second string attached to the second garment portion.

In another embodiment, the second body portion has a guide member on the back of the second body portion, the first string and the second string being threaded through the guide member. Additionally, the second body portion contains a locking tab that is attached to the first string and second string to lock the strings in place in back of the second body portion.

In an alternative embodiment, a doll contains a first body portion having a front, a back and a top. The first body portion contains a switch or switch engaging portion within the first body portion and hair mounted to the top of the first body portion. The hair is rotatably coupled to and engages the switch. Furthermore, the hair has a first side and a second side. Additionally, the switch is triggered when the second side of the hair is rotated to the front of the first body portion. The doll also includes a second body portion rotatably coupled to the first body portion having a front, a back, and an output mechanism operably connected to the switch and having at least two outputs. The switch dictates which one of the at least two outputs the output mechanism produces. Moreover, a dress capable of surrounding the back and front of the second body portion is connected to the back of the second body portion.

In another embodiment, the dress is convertible. The dress has a first garment portion and a second garment portion that can be positioned in front of the second body portion or behind the second body portion. Furthermore, the convertible dress contains a first string attached to the first garment portion and a second string attached to the second garment portion.

In another embodiment, the second body portion includes a guide member on the back of the second body portion with the first and second strings being threaded through the guide member. In addition, the second body portion contains a locking tab that is attached to the first string and the second string to lock the strings in place in the back of the second body portion.

In yet another embodiment, a doll comprises a first body portion having a front, a back and a top, the first body portion containing a switch within the first body portion and hair rotatably mounted to the top of the first body portion and rotatably coupled to the switch, a second body portion having a front, a back, and an output mechanism operably connected to the switch and having at least two outputs, the switch dictating which one the at least two outputs the output mechanism performs, and a reconfigurable garment, the reconfigurable garment being placeable in a first configuration resembling a first type of garment and in a second configuration resembling a second type of garment.

In an alternative embodiment, the reconfigurable garment of the doll in its first configuration surrounds at least part of the second body portion and in its second configuration is located behind the at least part of the second body portion.

In an alternative embodiment, the reconfigurable garment of the doll resembles a dress in its first configuration.

In an alternative embodiment, the reconfigurable garment of the doll includes a first garment portion and a second garment portion that can be positioned in the front of the second body portion or the back of the second body portion.

In an alternative embodiment, the reconfigurable garment of the doll further comprises a first string attached to the first garment portion and a second string attached to the second garment portion.

In an alternative embodiment, the second body portion further comprises a guide member on the back of the second body portion, and the first string and the second string are threaded through the guide member.

In an alternative embodiment, a locking tab is attached to the first string and second string to lock the strings in place in the back of the second body portion.

In another embodiment, a doll comprises a body portion and a convertible or reconfigurable dress coupled to the body portion, the reconfigurable dress including a first garment portion and a second garment portion that can be positioned in the front of the body portion or behind the body portion, the reconfigurable dress further comprising a first string attached to the first garment portion and a second string attached to the second garment portion, the first and second strings being useable to move the reconfigurable dress from a first configuration to a second configuration, the reconfigurable further comprising a guide member, and each of the first string and the second string is threaded through the guide member.

In an alternative embodiment, the doll further comprises a locking tab attached to the first string and second string to lock the strings in place relative to body portion.

In an alternative embodiment, the locking tab is located behind the body portion.

In an alternative, the doll further comprises a switch disposed within the body portion and an output mechanism disposed within the body portion, the output mechanism being operatively connected to the switch, wherein activation of the switch dictates an output of the output mechanism.

In an alternative embodiment, the doll further comprises hair rotatably mounted on the body portion and rotatably coupled to the switch.

In yet another embodiment, a doll comprises a first body portion including a switch, a second body portion including a front, a back, and an output mechanism, the output mechanism being operatively connected to the switch of the first body portion, and a reconfigurable garment with a first side and a second side, the reconfigurable dress being coupled to the second body portion and placeable in a first configuration resembling a first type of garment and a in a second configuration resembling a second type of garment. In this embodiment, the reconfigurable dress further comprises a first string coupled to the first side, and a second string coupled to the second side, where the first and second strings are usable to reconfigure the garment from the first configuration to the second configuration.

In an alternative embodiment, the doll further comprises a locking tab located attached to the first string and second string to lock the strings in place relative to second body portion.

In an alternative embodiment, the output mechanism includes at least two outputs and the switch dictates which one of the at least two outputs the output mechanism performs. In this embodiment, the output mechanism is a speaker.

In an alternative embodiment, the second body portion includes an actuator coupled thereto, the actuator being activatable by a child to cause the output mechanism to perform an output.

BRIEF DESCRIPTION OF THE DRAWINGS

Like reference numerals have been used to identify like elements throughout this disclosure.

DETAILED DESCRIPTION OF THE INVENTION

It is to be understood that terms such as "left," "right," "top," "bottom," "front," "end," "rear," "side," "height," "length," "width," "upper," "lower," "interior," "exterior," "inner," "outer" and the like as may be used herein, merely described points or portions of reference and do not limit the present invention to any particular orientation or configuration. Further, terms such as "first," "second," "third," etc., merely identify one of a number of portions, components, and/or points of reference as disclosed herein, and do not limit the present invention to any particular configuration or orientation.

A reconfigurable doll according to the present invention includes a first body portion and a second body portion rotatably coupled to one another, the first body portion containing a switch engaging portion and hair, and the second body portion containing a switch and an output mechanism connected to the switch. In one embodiment, when the hair is rotated about the first body portion, the switch is actuated. In one embodiment, the output mechanism has at least two outputs. The output mechanism produces one of at least two outputs based on whether or not the switch is actuated. In one embodiment, the doll includes a reconfigurable dress attached to the back of the second body portion.

Figure 1:
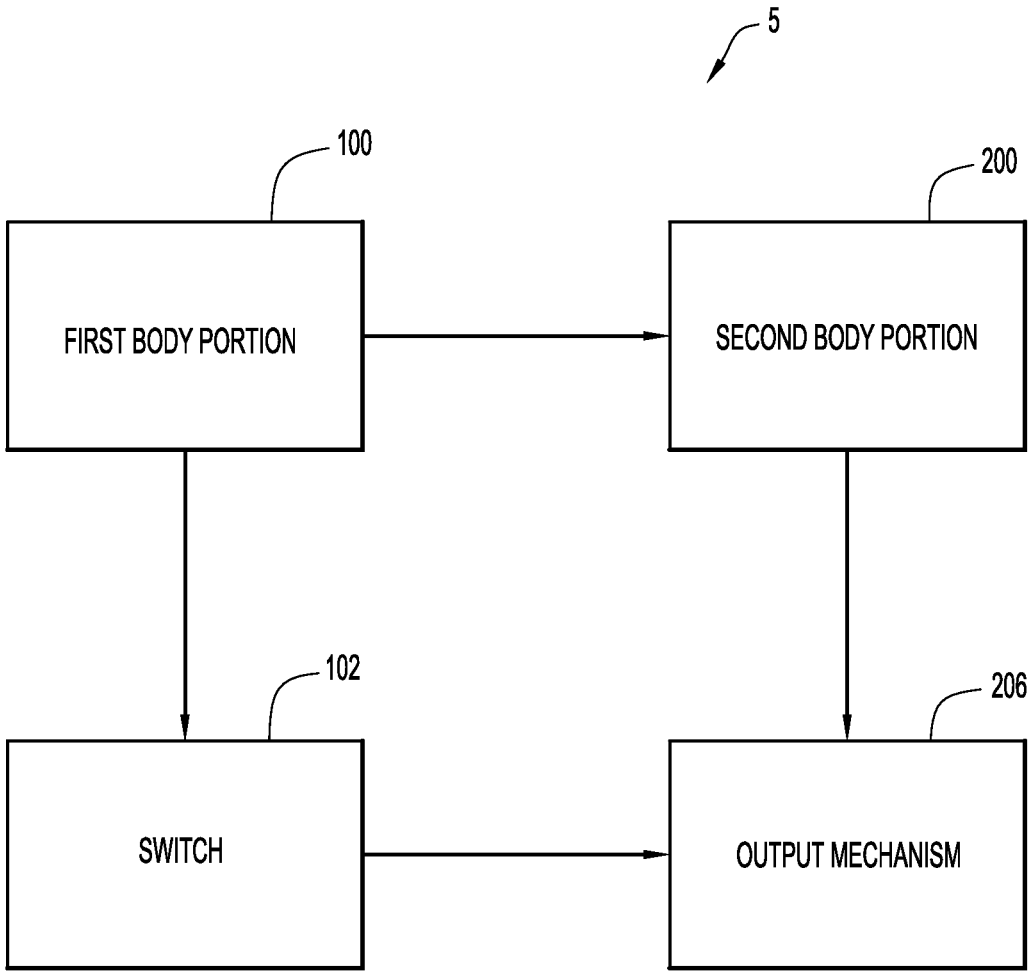
FIG. 1 illustrates a schematic block diagram of an embodiment of product according to the present invention.

FIG. 1 illustrates a schematic diagram of one embodiment of a doll 5 that contains a first body portion 100 and a second body portion 200 movably coupled to each other. The first body portion 100 contains a switch 102. The second body portion 200 contains an output mechanism 206 that is configured to generate at least two outputs. The output mechanism 206 and the switch 102 are operably configured for the output mechanism 206 to produce one of the at least two outputs depending on whether or not the switch 102 has been actuated.

Figure 2:
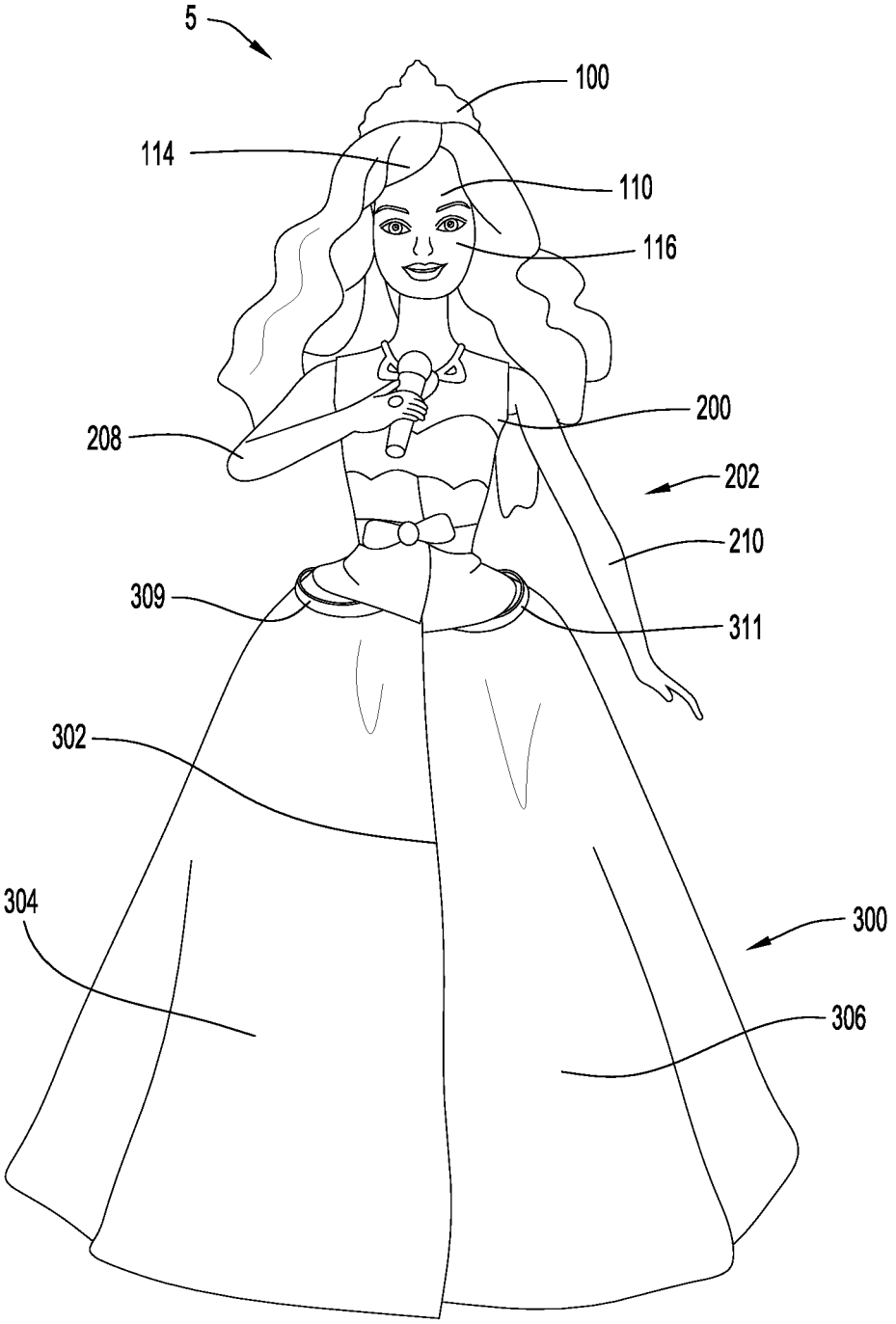
FIG. 2 illustrates a front view of one embodiment of a doll according to the present invention in a first orientation.
Figure 3:
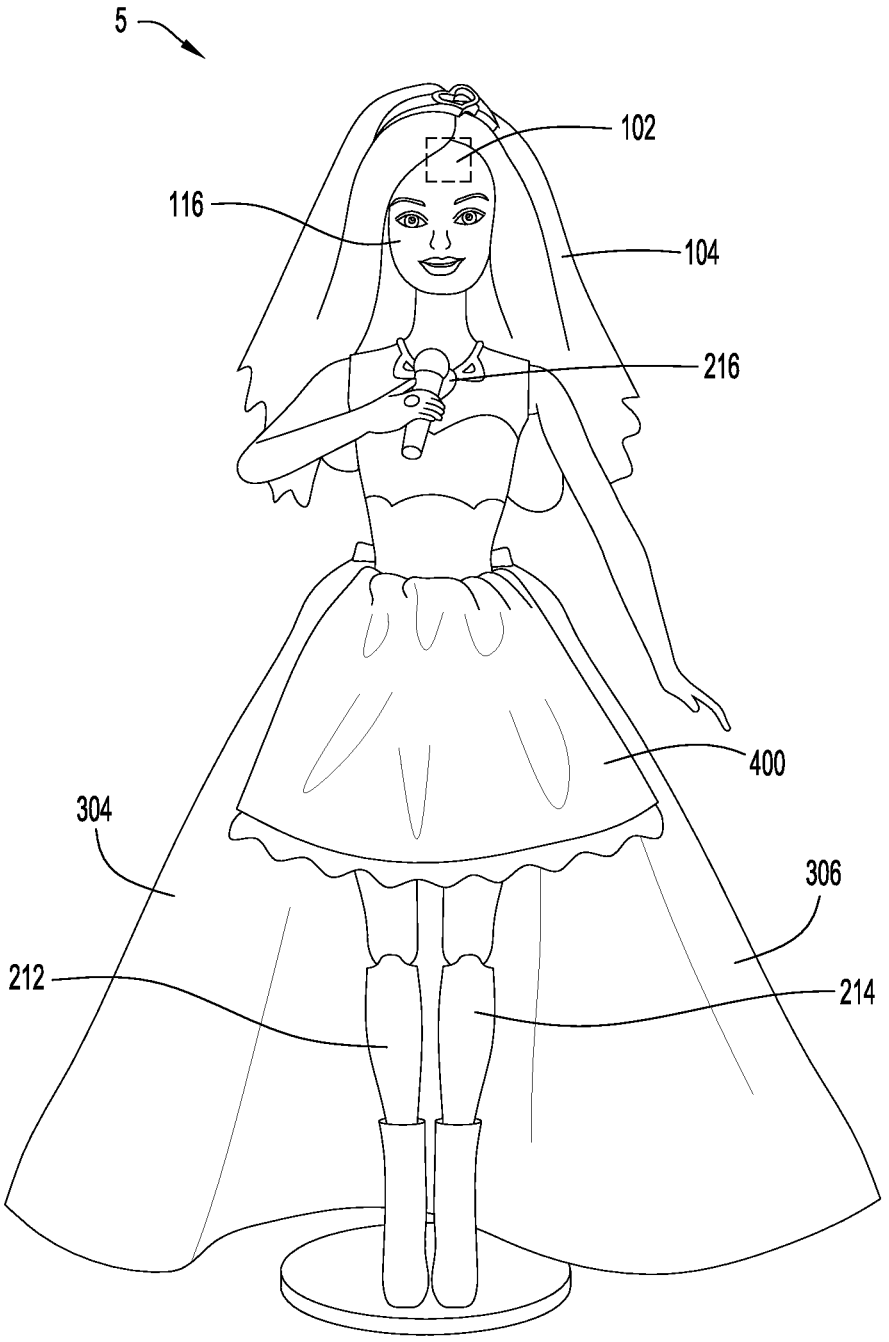
FIG. 3 illustrates a front view of the doll of FIG. 2 in a second orientation, different from the first orientation.

Referring to FIGS. 2 and 3, one embodiment of the doll 5 is illustrated. In FIG. 2, the doll 5 is configured to be in a first configuration, and in FIG. 3, the doll is configured to be in a second configuration. In this embodiment, the doll in the first configuration resembles a princess and the doll in the second configuration resembles a singing pop star. Doll 5 contains a first body portion 100 and a second body portion 200. First body portion 100 has a front 110, a back 112 (see FIGS. 8 and 9), and a top 114. The front 110 of the doll 5 contains a face 116. Furthermore, in this embodiment, attached to top 114 of first body portion 100 is hair 104. As illustrated by FIG. 3, within first body portion 100 is switch 102. Hair 104 is rotatably coupled to the switch 102. As the hair 104 is rotated about the top 114 of first body portion 100, the switch 102 is actuated by a portion of the head to which the hair is coupled.

Figure 4:
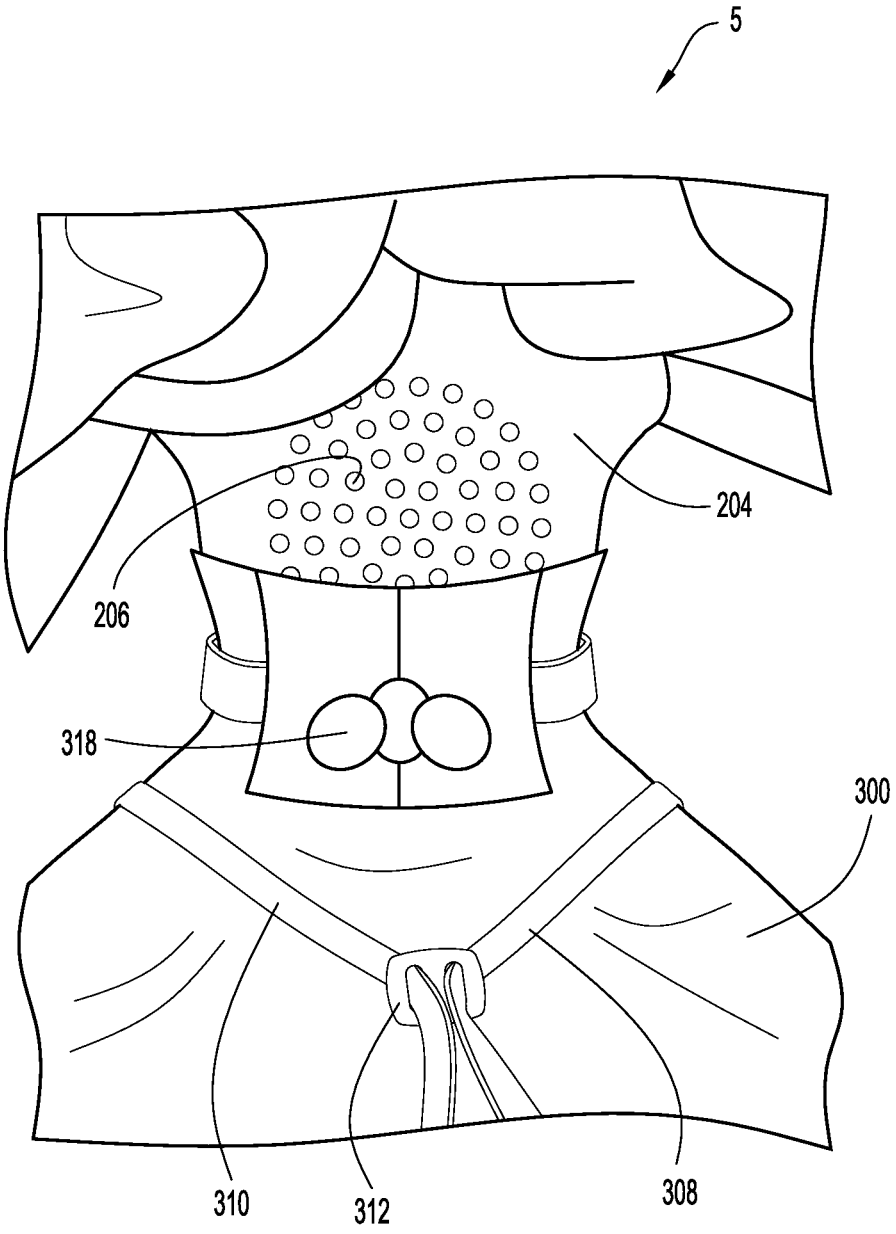
FIG. 4 illustrates a rear view of a portion of the back of the doll of FIG. 2 showing the output mechanism and guide member of the present invention.

Continuing with FIGS. 2 and 3, attached to first body portion 100 is second body portion 200. Second body portion 200 contains a front 202, and a back 204 (as seen in FIG. 4). Furthermore, extending from second body portion 200 is a first arm 208, a second arm 210, a first leg 212, and a second leg 214. In addition, attached to the second body portion is a dress or garment 300, which is reconfigurable. The dress 300 contains a first garment portion 304 and a second garment portion 306, which together form a front slit 302 on the front 202 of the second body portion 200 of the doll 5. In FIG. 2, the first garment portion 304 and the second garment portion 306 are unfolded and located in the front or the front area of the second body portion 200. In FIG. 3, the garment portions 304, 306 are folded back or moved rearwardly, revealing a skirt 400 attached to the second body portion 200, and first and second legs 212, 214. Moreover, second body portion 200 contains an actuator 216 that is used to actuate the output mechanism (seen in FIG. 4). In this embodiment, actuator 216 is located on the front 202 of second body portion 200, but may also be located on the back 204 of the second body portion 200, the arms 208, 210, the legs 212, 214, or the first body portion 100. In one embodiment, the actuator 216 is a toy necklace coupled to the body or bodice of the doll. Different songs or audible outputs are activated by pressing the actuator 216. A tact switch is located behind or inside of the necklace that is activated to cause the electronic system of the doll to generate audible outputs.

Referring to FIG. 4, the back 204 of the second body portion 200 is illustrated. As illustrated, in this embodiment, the dress 300 is attached to the back 204 of the second body portion 200 by dress attachment 318. Furthermore, the output mechanism 206 (shown relative to speaker holes) is located on the back 204 of the second body portion 200. In other embodiments, the output mechanism 206 may be located on other area including the front 202 of the second body portion 200, or even the first body portion 100. Moreover, as illustrated in FIG. 4, a first string 308 is attached to the first garment portion 304 at first connection point 309 (see FIGS. 2, 8, and 9) and a second string 310 is attached to the second garment portion 306 at second connection point 311 (see FIGS. 2, 8, and 9). In this embodiment, the strings 308, 310 converge together at guide member 312, which is in the form of a buckle 313. In other embodiments, the guide member 312 may be a pair of fabric loops 320 in dress 300, similar to that of belt loops, shown in FIGS. 8 and 9.

Figure 5:
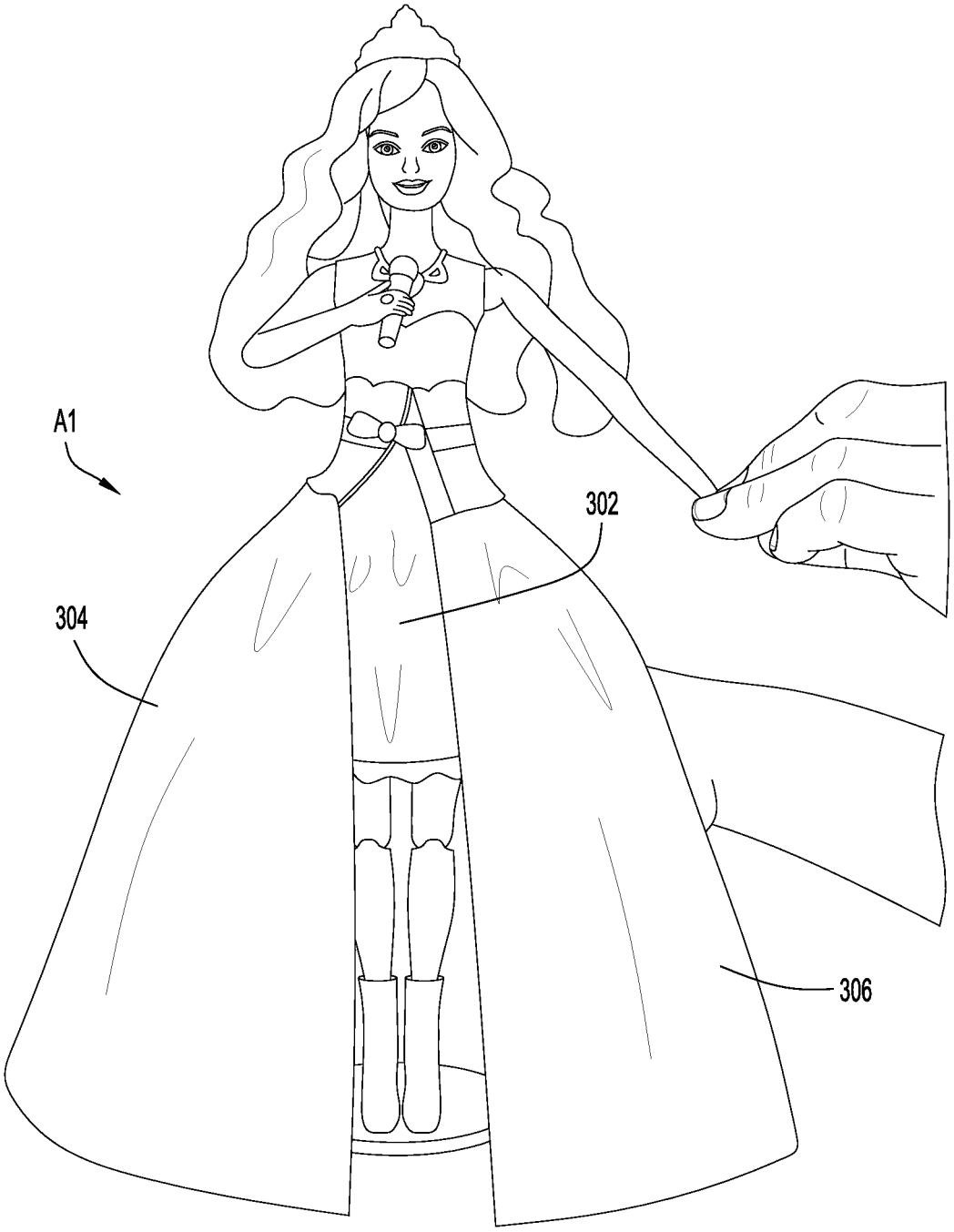
FIGS. 5-7 illustrate front views of the doll of FIG. 2 in various stages of transformation between the first orientation of FIG. 2 and the second orientation of FIG. 3.
Figure 6:
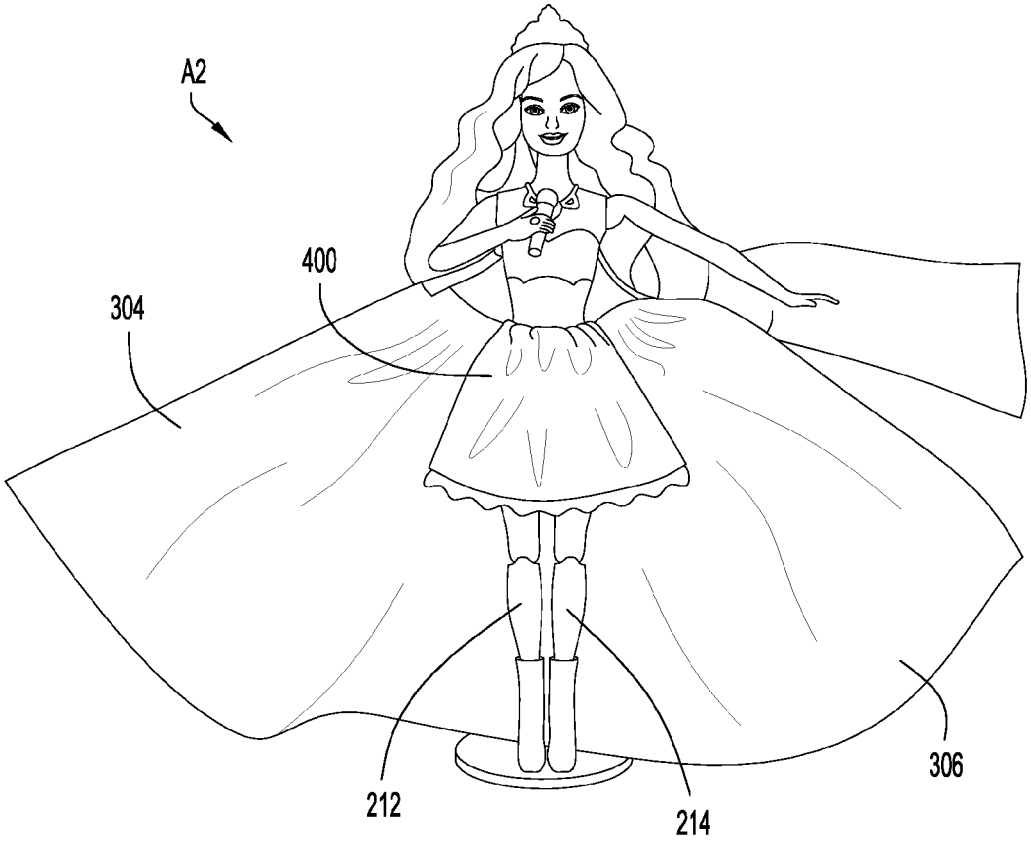
Figure 7:
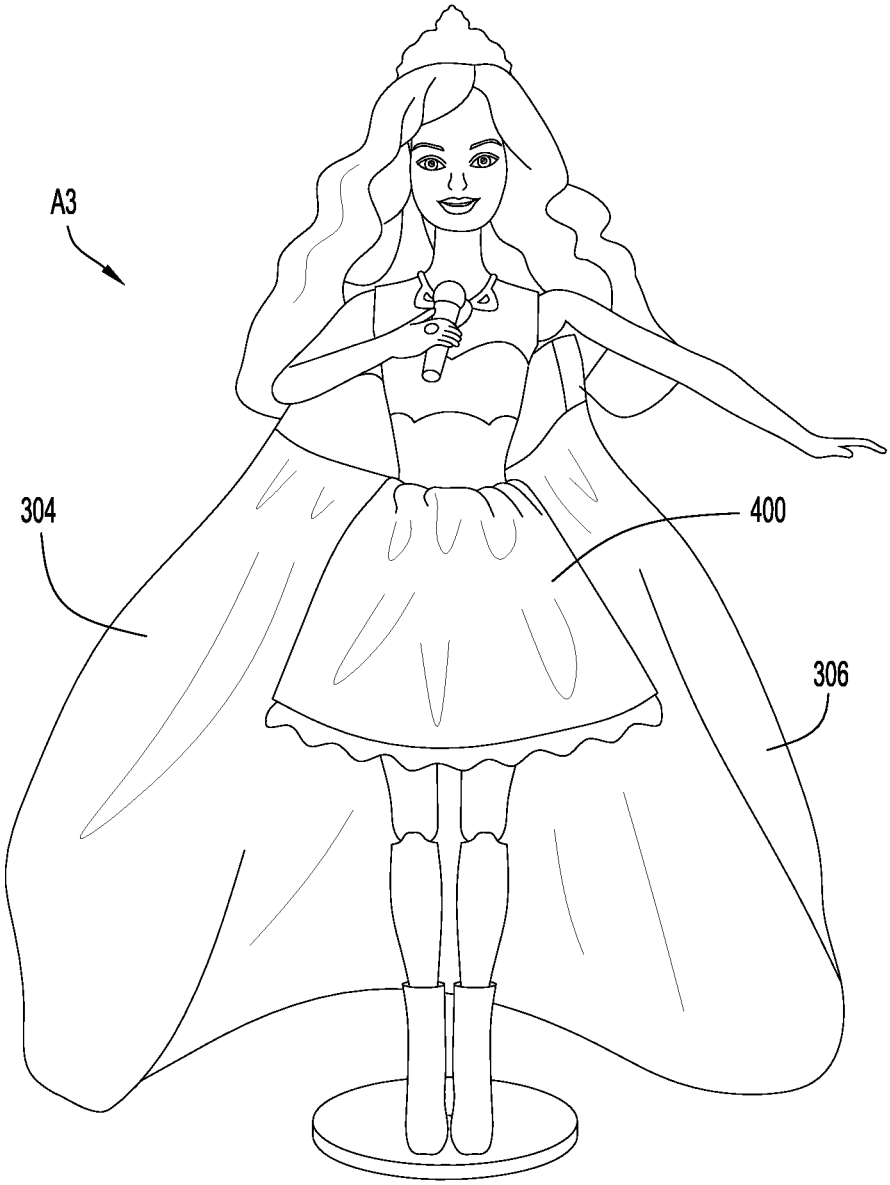

Referring to FIGS. 5, 6, and 7, illustrated is a series of transformation steps A1, A2, A3 to transform the dress 300 from the first orientation, as illustrated in FIG. 2, to the second orientation, as illustrated in FIG. 3. FIG. 5 illustrates the beginning of the transformation phase A1 of the dress 300. The transformation of the dress 300 begins with a user 500 pulling the strings 308, 310 located in the back 204 of the second body portion 200 (as shown in FIG. 4). Because the first and second strings 308, 310 are attached to the first and second garment portions 304, 306, respectively, when the strings 308, 310 are pulled, the garment portions 304, 306 begin to separate at the front 202 of the second body 200. When the garment portions 304, 306 begin to separate at the front 202 of the second body 200, the front slit 302 becomes larger, until it is no longer a slit, as in transformation stage A2, illustrated in FIG. 6.

Continuing with FIG. 6, illustrated is the second transformation stage A2 of the dress 300 of the doll 5. In the second transformation stage A2 of the dress 300, the continued pulling of the strings 308, 310 has pulled the garment portions 304, 306 farther toward the back 204 of the second body portion 200. As illustrated in FIG. 3, the garment portions 304, 306 have opened up the dress 300 revealing the skirt 400 and legs 212, 214 of the doll 5.

Referring to FIG. 7, the third transformation stage A3 of the dress 300 is illustrated. In the third transformation stage A3, the garment portions 304, 306 of the dress 300 are almost completely folded or moved to the back 204 of the second body portion 200. With the garment portions 304, 306 nearly completely moved and folded, the skirt 400, which was under the dress 300, is completely reveled. The duration of the transformation process A1, A2, A3 depends on the force pulled on the first and second strings 308, 310 by the user 500. The greater the force used to pull first and second strings 308, 310 results in the transformation process A1, A2, A3 of the dress 300 occurring faster.

Figure 8:
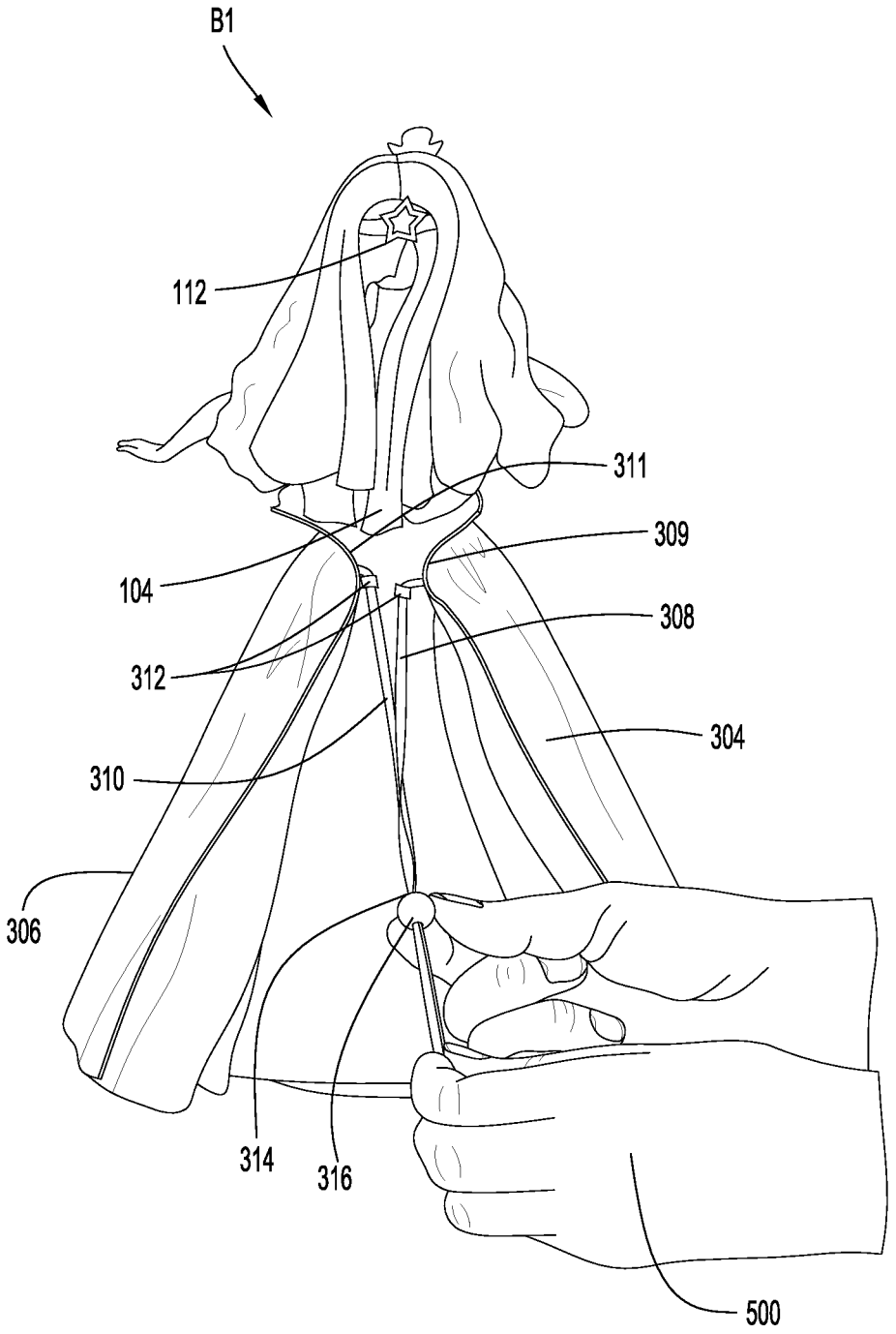
FIGS. 8-9 illustrate rear views of the doll of FIG. 2 showing the strings and locking tab of the dress of the doll with the locking tab in a first position and in a second position, respectively.
Figure 9:
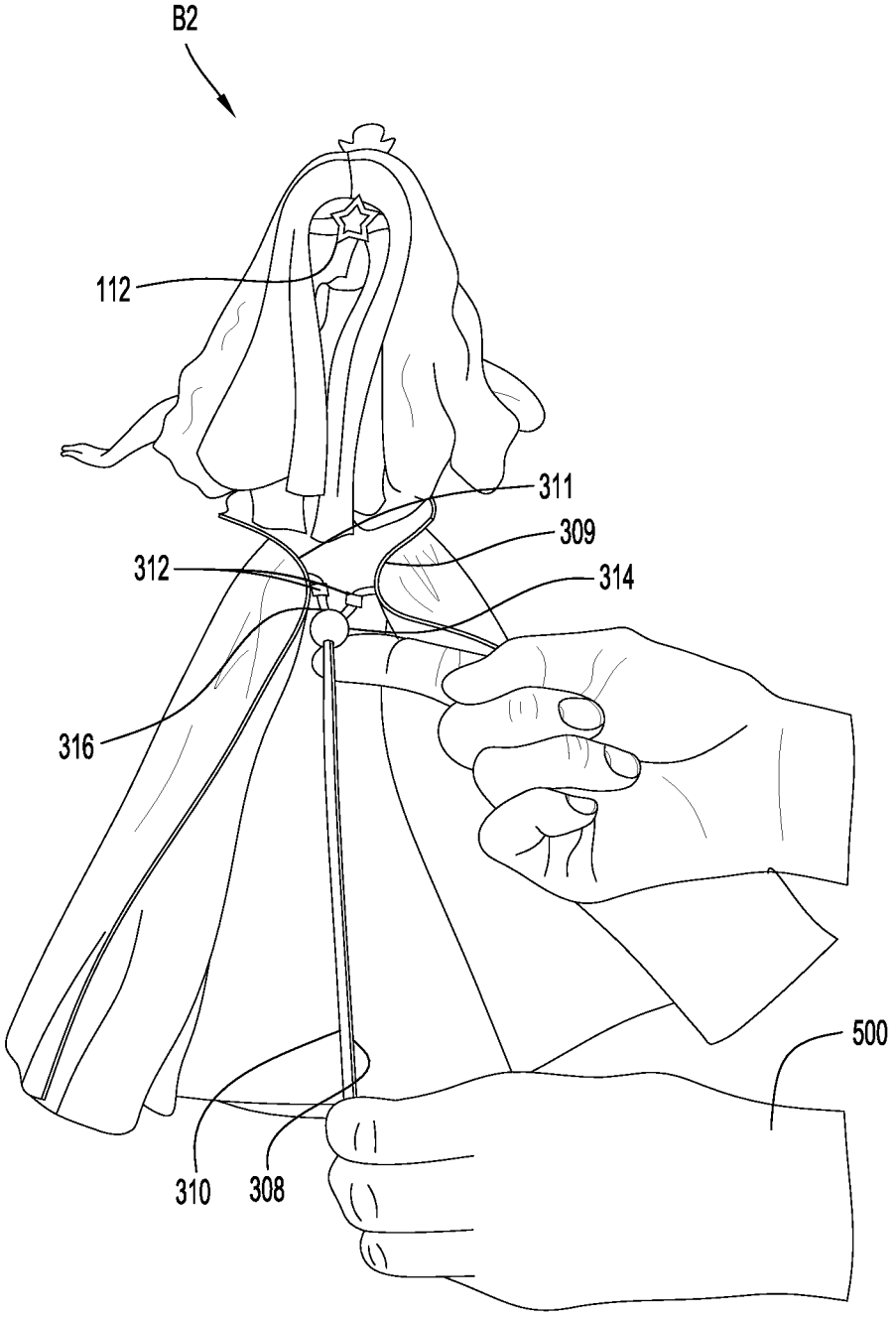

Referring to FIGS. 8 and 9, illustrated is the securement of the garment portions 304, 306 of the dress 300 to the back 204 of the second body portion 200. Illustrated in FIGS. 8 and 9 are the back 204 of the second body portion 200 and the back 112 of the first body portion 100. In FIG. 8, the first string 308 and the second string 310 are being pulled by a user 500. As previously explained, the first string 308 and the second string 310 have been threaded through guide member 312, which is located on the dress 300. In this embodiment, guide member 312 is in the form of fabric loops 320. In addition, first string 308 and second string 310 are threaded through locking tab 314. In this embodiment, locking tab 314 is configured to resemble a gem 316, but may be a variety of shapes and configurations in other embodiments. In FIG. 8, the locking tab 314 is positioned in rear dress orientation B1, where the locking tab 314 is located on the strings 308, 310 away from the guide member 312. While in rear dress orientation B1, the first garment portion 304 and the second garment portion 306 are moved completely to the back 204 of the second body portion 200, and their connection points 309, 311 are positioned adjacent to the guide member 312. However, in this orientation, if the user 500 lets go of the strings 308, 310, the garment portions 304, 306 would unfold, pulling strings 308, 310 through guide member 312 until the locking tab 314 reached the guide member 312, preventing any further movement of the strings 308, 310 and the fold portions 304, 306.

Continuing with FIG. 9, illustrated is the back 204 of the second body portion 200 with the locking tab 314, strings 308, 310, and garment portions 304, 306 of the dress 300 in rear dress orientation B2. In orientation B2, the locking tab 314, has been slid upwards along the strings 308, 310 closer to guide member 312. Furthermore, the connection points 309, 311 have been drawn adjacent to the guide member 312 by the strings 308, 310. When in rear dress orientation B2 the user 500 can release the strings 308, 310 because the strings 308, 310 have been slid substantially through the locking tab 314, placing the locking tab 314 adjacent to the guide member 312, and the locking tab 314 has locked the strings 308, 310 in place. When a user 500 releases the strings 308, 310 in rear dress orientation B2, the garment portions 304, 306 are held in the folded position of A3 (as seen in FIG. 7) because, the locking tab 314 prevents the strings 308, 310 from moving through the guide member 312, holding the connection points 309, 311 adjacent to the guide member 312.

Figure 10:
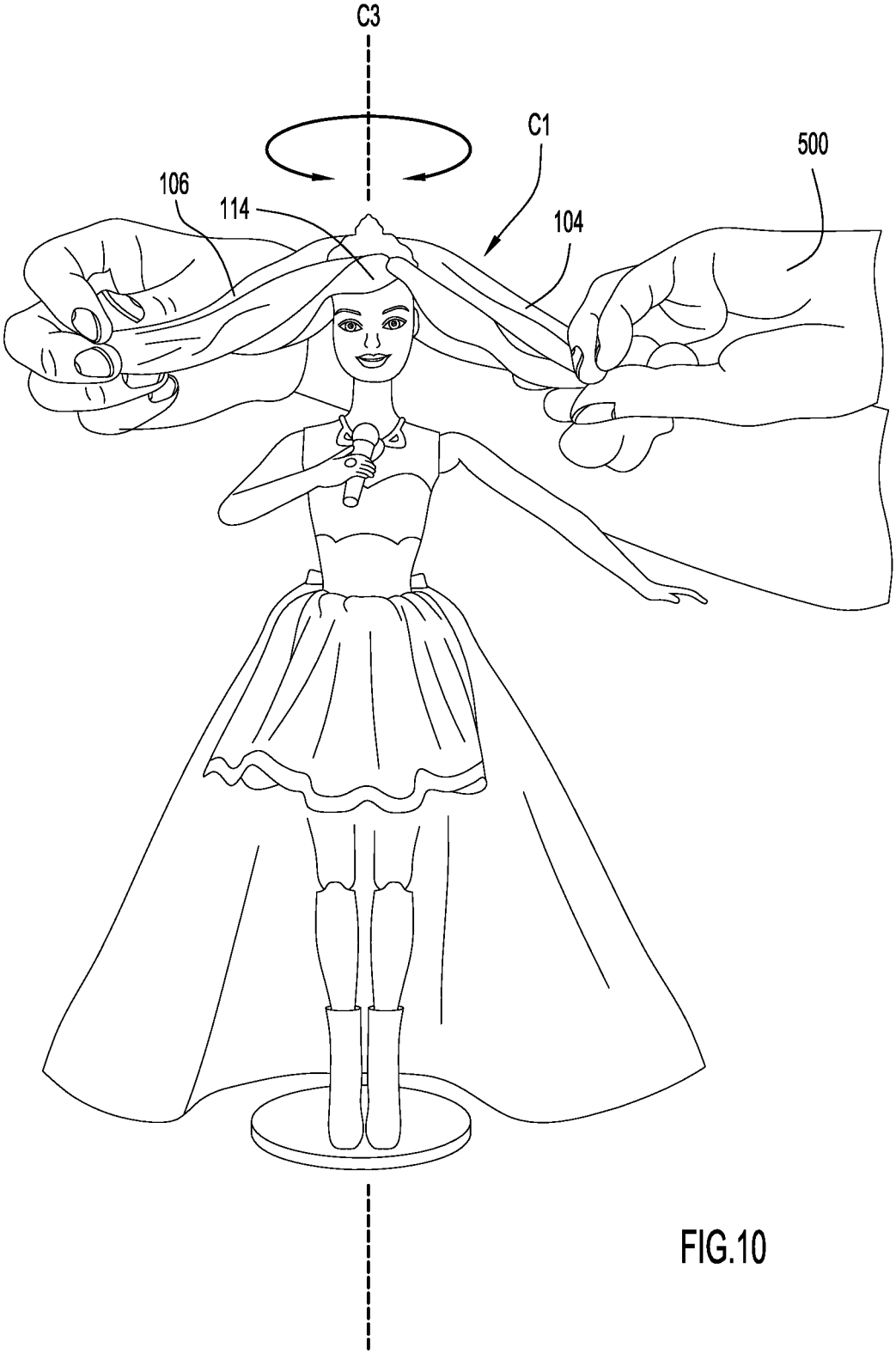
FIG. 10 illustrates a front view of the doll of FIG. 2 with the hair in a first hair transformation stage being transformed from the first orientation of FIG. 2 to the second orientation of FIG. 3.
Figure 11:
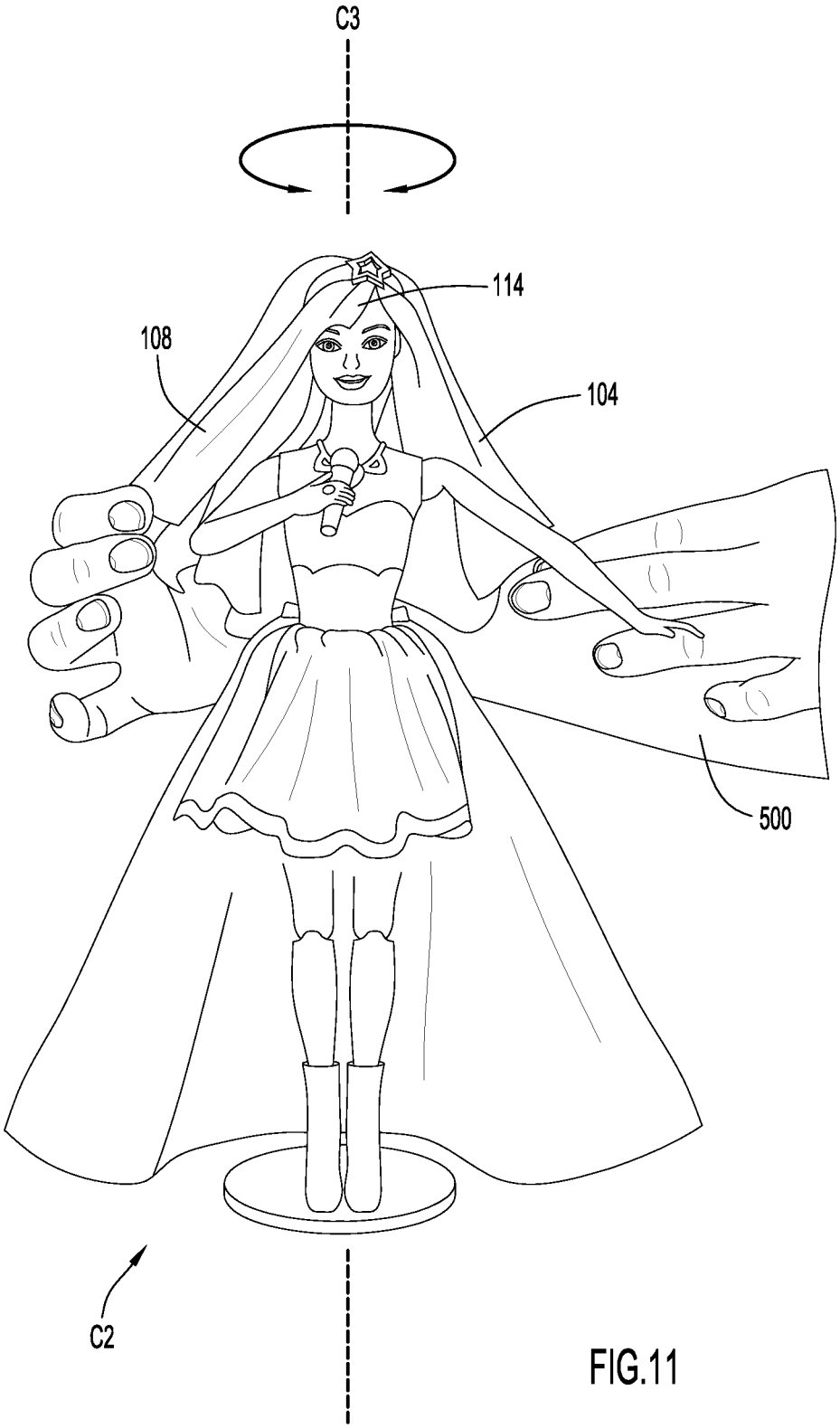
FIG. 11 illustrates a front view of the doll of FIG. 2 with the hair in a second hair transformation stage being transformed from the first orientation of FIG. 2 to the second orientation of FIG. 3.

Referring to FIGS. 10 and 11, illustrated is the transformation of the hair 104 from orientation C1 to orientation C2. Illustrated in FIG. 10 is the doll 5 with the hair 104 in orientation C1, where the first side 106 of the hair is facing forward on the doll 5. The hair 104 is positioned on the top 114 of the first body portion 100. As illustrated in FIG. 10, the user 500 is grasping the hair 104 in preparation for rotating the hair 104 from first hair orientation C1 about rotation axis C3 to second hair orientation C2. Second hair orientation C2 is illustrated in FIG. 11, where the second side 108 of the hair 104 is facing forward on the doll 5. The hair 104 can rotate about the axis C3 in either a clockwise or counter clockwise rotation.

As previously described above, when the hair 104 is rotated about the axis C3, the switch 102 is actuated. As illustrated in FIG. 3, the switch 102 is disposed within the first body portion 100 and rotatably connected to the hair 104. Additionally, the switch 102 is operably connected to the output mechanism 206 (as seen in FIG. 4). In this embodiment, the output mechanism 206 contains at least two outputs, one that corresponds to the first side 106 of the hair 104 being oriented in the front, the other corresponding to the second side 108 of the hair 104 being oriented in the front. When the hair 104 is rotated from the first hair orientation C1 to the second hair orientation C2, the switch 102 is actuated, or switched to the "on" position, changing the output of the output mechanism 206 to correspond to the second side 108 of the hair 104. When the hair 104 is rotated back to the first hair orientation C1, the switch 102 is actuated again, or switched to the "off" position, changing the output mechanism 206 to correspond with the first side 106 of the hair 104. In other embodiments, the output mechanism may contain more than two outputs that are activated by a switch.

In an alternative embodiment, a toy or simulated microphone may be coupled to the hand of the doll. The corresponding arm holding the microphone can function as a switch to trigger among various songs or audible outputs. The songs or music generated by the doll can vary with respect to the appearance of the doll, including its garments, as well as the outfit mode of the doll. Thus, the doll can play a song selected randomly every time the arm with the microphone is raised up by her mouth. Accordingly, the doll can generate outputs for either hair configuration or appearance at any time. In this embodiment, a switch in the shoulder region of the doll is triggered by the movement of the arm once the arm reaches a particular level or position.

Although the disclosed inventions are illustrated and described herein as embodied in one or more specific examples, it is nevertheless not intended to be limited to the details shown, since various modifications and structural changes may be made therein without departing from the scope of the invention and within the scope and range of equivalents of the claims. For example, although the illustrated embodiments are shown with a doll having two types of hair and two outputs, the case of the present invention could be used with any number of hair styles and number of outputs. In addition, various features from one of the embodiments may be incorporated into another of the embodiment. Accordingly, it is appropriate that the claims be construed broadly and in a manner consistent with the scope of the disclosure as set forth in the following claims.

What is claimed is:

1. A doll comprising:

a first body portion having a front, a back and a top, the first body portion containing a switch within the first body portion and hair coupled to the top of the first body portion, the hair containing a first side and a second side opposite the first side, the hair being rotatable with respect to the first body portion about a vertical axis between a first orientation, where the first side of the hair is oriented proximate to the front of the first body portion, and a second orientation, where the second side of the hair is oriented proximate to the front of the first body portion, where rotation of the hair between the first orientation and the second orientation actuates the switch;

a second body portion having a front, a back, and an output mechanism operably connected to the switch and having at least two outputs, the switch dictating which one the at least two outputs the output mechanism performs; and a reconfigurable garment, the reconfigurable garment being placeable in a first configuration resembling a first type of garment and in a second configuration resembling a second type of garment.

2. The doll of claim 1, wherein the reconfigurable garment in its first configuration surrounds at least part of the second body portion and in its second configuration is located behind the at least part of the second body portion.

3. The doll of claim 1, wherein the reconfigurable garment resembles a dress in its first configuration.

4. The doll of claim 1, wherein the reconfigurable garment includes a first garment portion and a second garment portion that can be positioned in the front of the second body portion or the back of the second body portion.

5. The doll of claim 4, wherein the reconfigurable garment further comprises a first string attached to the first garment portion and a second string attached to the second garment portion.

6. The doll of claim 5, wherein the second body portion further comprises a guide member on the back of the second body portion, and the first string and the second string are threaded through the guide member.

7. The doll of claim 6, wherein a locking tab is attached to the first string and second string to lock the strings in place in the back of the second body portion.

8. The doll of claim 1, wherein the second body portion includes an actuator coupled thereto, the actuator being activatable by a child to cause the output mechanism to perform an output.

9. The doll of claim 8, wherein the doll includes a bodice and the actuator is a toy necklace coupled to the bodice.

* * * * *